United States Patent [19]

Hauger et al.

[11] Patent Number: 4,457,470

[45] Date of Patent: Jul. 3, 1984

[54] IMPULSE SPRINKLER

[75] Inventors: Harry L. Hauger; Glenn I. Beal, both of Somerset, Pa.

[73] Assignee: R. M. Smith, Inc., Somerset, Pa.

[21] Appl. No.: 365,400

[22] Filed: Apr. 5, 1982

[51] Int. Cl.[3] ..... B05B 3/08

[52] U.S. Cl. ..... 239/230

[58] Field of Search ..... 239/230–233, 239/503, 522, DIG. 1

[56] References Cited

U.S. PATENT DOCUMENTS

| | | | |
|---|---|---|---|
| 3,022,012 | 2/1962 | Sharp et al. | 239/230 |
| 3,921,912 | 11/1975 | Hayes | 239/DIG. 1 X |
| 3,977,610 | 8/1976 | Royer | 239/230 |
| 4,191,331 | 3/1980 | Bivens et al. | 239/522 X |

FOREIGN PATENT DOCUMENTS

| | | | |
|---|---|---|---|
| 2343512 | 10/1977 | France | 239/230 |

*Primary Examiner*—John J. Love

*Attorney, Agent, or Firm*—Reed, Smith, Shaw & McClay

[57] ABSTRACT

An impulse sprinkler assembly is provided with a liquid stream-intersecting arm formable by open-and-shut injection molding techniques and having a pair of stream-diverting surfaces. Control over the direction of stream discharge is improved by providing a plurality of upraised ribs on the face of at least one of the stream diverting surfaces to minimize liquid thickness nonuniformities during flow thereacross.

4 Claims, 4 Drawing Figures

IMPULSE SPRINKLER

BACKGROUND OF THE INVENTION

1. Field of the Invention

The present invention relates to liquid sprinkler assemblies and more particularly to liquid sprinklers which rotate through a selected arcuate path in response to the impact of a liquid stream upon stream-intersecting surfaces.

2. Discussion of the Technical Problem

It is known to drive a rotatable liquid sprinkler by providing a stream-intersecting surface which is impacted upon by the emitted liquid stream. Examples of such devices include those taught in U.S. Pat. Nos. 2,256,737; 2,710,226; 3,022,012; 3,193,203; 3,350,015; 3,408,099; 3,434,665; 3,581,994; 3,764,073; 3,765,608; 3,779,462; 3,837,576; 3,841,563; 3,918,643; 3,924,809; 3,930,617; 3,952,953; 3,977,610; 4,055,304; 4,153,202; 4,173,306; 4,195,782; 4,216,913; 4,234,126; and 4,235,379. Commonly the stream-intersecting surface oscillates into and out of the discharge stream of liquid and impact energy is temporarily stored in a spring to rotate the assembly about an axis and return the stream-intersecting surface into the discharge stream.

Difficulties with such devices are encountered, however, because satisfactory control over the direction of fluid discharge has been largely unattainable heretofore. While the arc of rotation of the sprinkler facility has been largely controllable through mechanical means, there nevertheless exists a need for improved control over the direction of fluid discharge, because of the flow disruption created by the stream-intersecting surface.

Additionally, it is desirable to fabricate a sprinkler assembly from plastic components, preferably having a design which permits the use of open-and-shut injection molding techniques for production economy. In this regard U.S. Pat. No. 3,977,610 is of interest. This patent discloses an oscillating sprinkler which includes a pivotable arm having a pair of concave stream-impacting vanes which are spaced relative to one another such that they overlap neither laterally nor longitudinally relative to the original direction of fluid discharge. The vane closest to the discharge unit directs the fluid stream toward the more distant of the vanes.

A pivotable arm having such vanes may conveniently be formed of plastic by open-and-shut injection molding techniques, in that a lateral opening between the pair of vanes exists due to the lack of overlap therebetween which facilitates separation of the mold parts. However, control over the direction of fluid discharge has been found to be unsatisfactory because a portion of the fluid stream undesirably exits through the lateral opening between the vanes rather than continuing in the desired direction. It can be appreciated that this condition wastes water and may create substantial inconveniences by dispersing water onto undesirable areas. Thus there exists a need in the art for a method of controlling the direction of fluid dispersal from an impulse sprinkler, particularly in conjunction with the use of relatively inexpensive plastic components which may be formed by open-and-shut injection molding techniques.

SUMMARY OF THE INVENTION

The present invention provides an impulse sprinkler having a facility for directing a liquid stream in a predetermined direction, and a stream-diverting surface which is spaced from the directing facility and intersects the liquid stream to divert the stream from the predetermined direction, the stream-diverting surface including a plurality of spaced, upraised ribs extending generally parallel to the desired direction of flow of liquid across the stream-diverting surface to improve the control over such flow. Preferably, the sprinkler includes an impulse arm mounting the stream-diverting surface in spaced, non-overlapping relation with a second stream-diverting surface such that a lateral opening exists therebetween which facilitates the fabrication of the impulse arm by an open-and-shut injection molding technique. The plurality of spaced, upraised ribs controls liquid flow across the first stream-diverting surface to direct such flow onto the second stream-diverting surface while minimizing liquid dispersal through the lateral opening therebetween.

DESCRIPTION OF THE INVENTION

Figure 1:
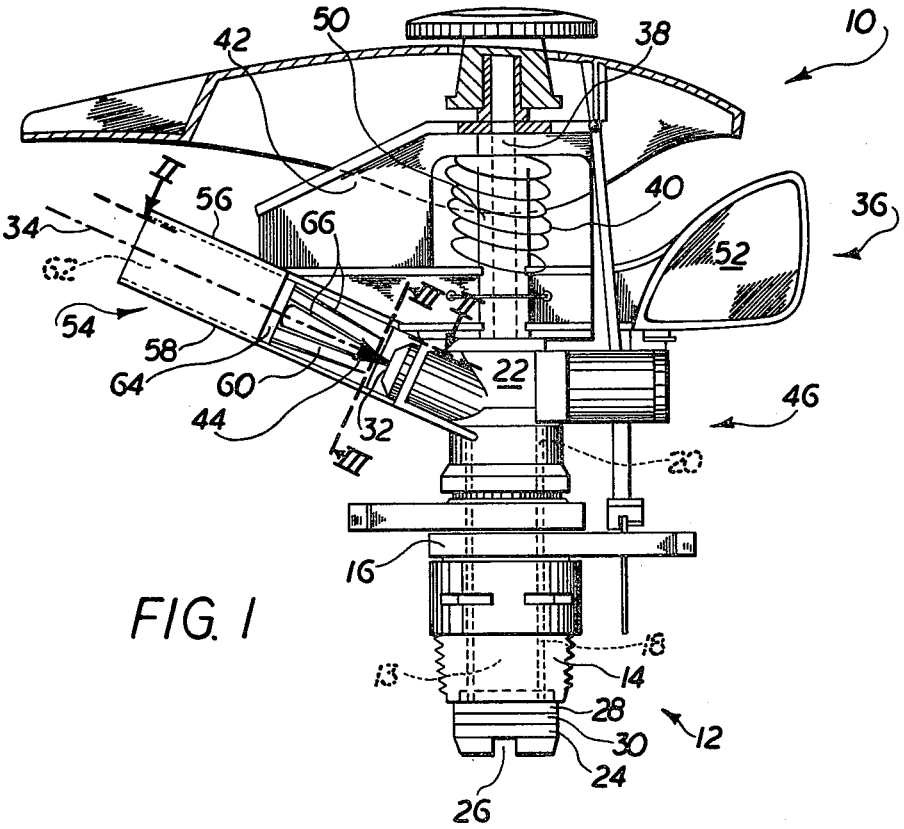
FIG. 1 is an elevated side view of an impulse sprinkler incorporating features of the present invention

With reference to FIG. 1, an impulse sprinkler 10 includes an elongated base member 12 having an internal bore 13 therethrough, a lower threaded end 14 and an upper end 16. A tubular spindle 18 is rotatably mounted within bore 13 of base member 12 with its upper end 20 secured to a body member 22 of the sprinkler 10. A lower enlarged end 24 of the spindle 18 includes a slot 26, and a bearing 28 and washer 30 are mounted between the enlarged end 24 and the lower threaded end 14 of the base member 12.

The body member 22 includes a nozzle 32 which communicates with the spindle 18 and which has a predetermined discharge axis 34, preferably upwardly angled. An arm 36 is pivotally mounted to the body member 22 by a vertical shaft 38, a return spring 40, and a stop member 42. A stream 44 emitted from the nozzle 32 impacts upon the arm 36 to displace it from the stop member 42, thereby generating an oscillatory motion in the arm 36 which serves to rotate the sprinkler about the axis of the base member 12. Facilities 46 are provided to control the extent of rotation of the sprinkler 10 in a manner known in the art. For a more detailed appreciation of the above-described structure, reference may be had to U.S. Pat. No. 3,977,610, which is hereby incorporated by reference.

Figure 2:
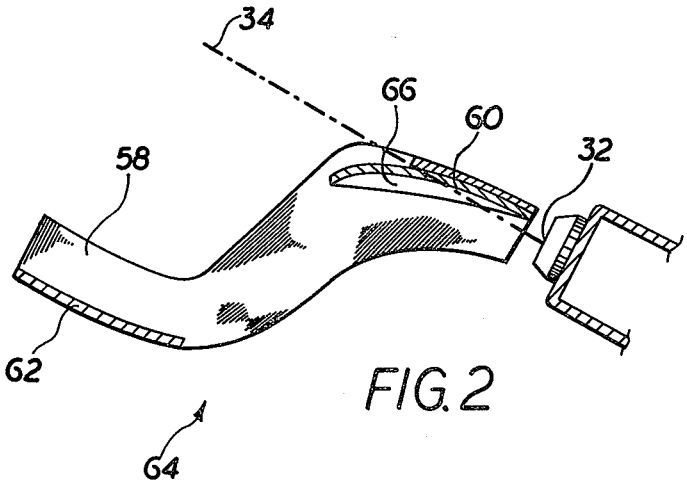
FIG. 2 is a view taken along lines 2—2 of FIG. 1.

With reference also to FIG. 2, the arm 36 preferably includes a vertical extension 50 about which spring 40 is mounted, a first extending leg 52, and a second stream-intersecting leg 54 incorporating features of the present invention. The leg 54 includes an upper planar surface 56 and a lower planar surface 58 extending in a generally parallel, upwardly angled relation one to another on opposite sides of the axis 34. Integral therewith and normal between the surfaces 56 and 58 is a first stream-diverting surface 60 and a second stream-diverting surface 62. The stream-diverting surfaces 60 and 62 are spaced from one another both laterally and longitudinally relative to the axis 34, and preferably have arcuate surfaces such that when the arm 36 is in contact with the stop member 42 the stream 44 exits the nozzle 32 along axis 34, is diverted in a first direction by impact with the first stream diverting surface 60 and is diverted in a second, generally equal but opposite second direction by impact with the second stream-diverting surface 62.

It has been determined, however, that the abovedescribed desired flow pattern is not readily attainable utilizing a smooth face on the first stream diverting surface 60, a substantial portion of the stream 44 exiting from the desired flow pattern through the lateral opening 64 which exists between the stream diverting surfaces 60 and 62. Attempts to prevent such uncontrolled flow by altering the radius of curvature of the surfaces 60 and 62 proved unsuccessful. To obtain the significant production advantages associated with the use of open-and-shut injection molding techniques, it is preferable that the lateral opening 64 not be eliminated. Thus, a troublesome problem existed.

Figure 3:
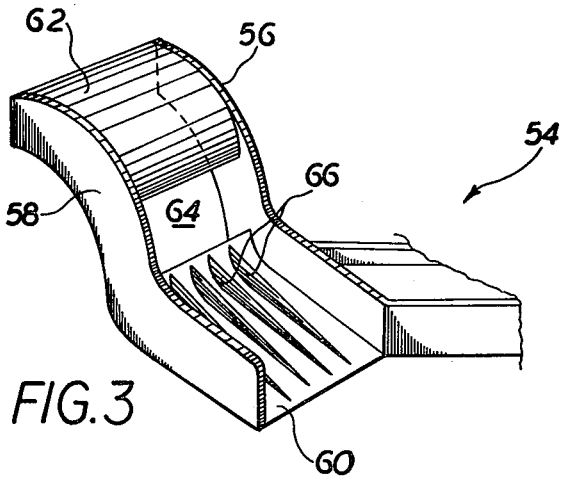
FIG. 3 is a view taken along lines 3—3 of FIG. 1.

In accordance with the present invention, and with reference also to FIG. 3, a plurality of upraised ribs 66 are provided on the face of the first stream-diverting surface 60 which effectively minimize the escape of a portion of the stream 64 through the lateral opening 64. The ribs 66 extend longitudinally along the surface 60, i.e., generally parallel to the desired direction of fluid flow along the surface 60. While the reasons for the success of the present invention in eliminating fluid dispersal through the lateral opening 64 may not be fully understood, it is theorized that the inclusion of the ribs 66 along the surface 60 maintains a fluid flow thereacross of a substantially uniform thickness. It is further believed that a lack of ribs 66, particularly at high fluid pressures, permits fluid layers of a relatively great thickness to form adjacent areas of intersection between the surface 60 and the planar surfaces 56 and 58, i.e., the corner areas, while only a thin fluid layer remains adjacent central portions of the surface 60. Such non-uniform thickness may result in flow perturbations and disruptions which result in a portion of the stream 44 exiting through the lateral passageway 64. Inclusion of the ribs 66 in accordance with the present invention is believed to minimize any such non-uniform distribution of flow, thereby avoiding undesirable flow disruptions, and permitting substantially improved flow control.

Figure 4:
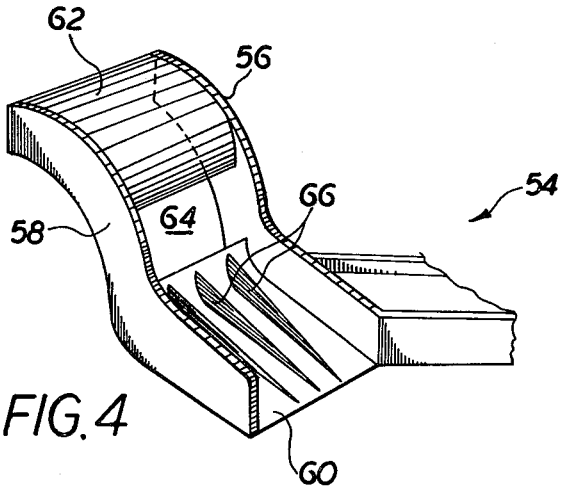
FIG. 4 is a view similar to the view of FIG. 3 showing a second embodiment of the invention.

In the embodiment of the invention shown in FIGS. 1 and 3, four ribs 66 are spaced apart on the surface 60, the inner two extending generally parallel to the axis 34, with the outer two diverging at a slight angle therefrom. In a preferred embodiment, the ribs may extend between about 0.01 inches (0.025 cm.) and about 0.10 inches (0.25 cm.) from the face of surface 60 at their widest point. Of course, the invention is not limited to the embodiment of FIGS. 1 and 3, for FIG. 4 illustrates an alternate embodiment including three ribs 70, a central one generally parallel to axis 34 and two outer ones preferably diverging therefrom. Accordingly, the scope of the present invention is only intended to be limited by the claims which follow.

We claim:

1. In an oscillating impulse sprinkler having a nozzle adapted to forcefully direct a stream of liquid along an axis in predetermined relation thereto and an impulse arm having first and second cooperating concave stream-diverting surfaces mounted in fixed relative spaced relation for integral movement to and from said stream with said concave surfaces disposed toward a predetermined stream path therebetween, the impact of said stream upon said first and second surfaces intermittently urging said sprinkler through a predetermined arcuate path, wherein said first surface is adjacent said nozzle and said second surface is spaced more distally from said nozzle in non-overlapping relation to said first surface to provide a lateral opening therebetween, wherein portions of said stream are diverted through said lateral opening as a result of nonuniform distribution of said stream along said first surface, the improvement comprising:

a plurality of spaced, upraised ribs on said first surface extending generally parallel to the direction of movement of said stream as it passes along said first surface, said ribs increasing the uniformity of distribution of said stream along said first surface and reducing the portion of said stream diverted through said lateral opening between said first and second surfaces.

2. The sprinkler as set forth in claim 1, wherein said plurality of spaced, upraised ribs include four ribs.

3. The sprinkler as set forth in claim 2, wherein said four ribs include an inner pair of parallel ribs and outer pair of moderately diverging ribs.

4. The sprinkler as set forth in claim 1, wherein said plurality of spaced, upraised ribs include three ribs, the outer ones of said ribs moderately diverging relative to one another.

* * * * *

UNITED STATES PATENT AND TRADEMARK OFFICE

CERTIFICATE OF CORRECTION

PATENT NO. : 4,457,470

DATED : July 3, 1984

INVENTOR(S) : HARRY L. HAUGER and GLENN I. BEAL

It is certified that error appears in the above-identified patent and that said Letters Patent are hereby corrected as shown below:

Column 3, line 23, after "stream" delete "64" and substitute therefor -- 44 --.

Signed and Sealed this

*Nineteenth* Day of *February 1985*

[SEAL]

*Attest:*

DONALD J. QUIGG

*Attesting Officer*

*Acting Commissioner of Patents and Trademarks*